United States Patent [19]

Buss et al.

[11] 4,057,241

[45] Nov. 8, 1977

[54] LAUNDRY FOLDER AND STACKER

[76] Inventors: Benjamin Alvin Buss; Stephen A. Buss, both of 1315 23rd Ave. Court, East Moline, Ill. 61244

[21] Appl. No.: 705,459

[22] Filed: July 15, 1976

Related U.S. Application Data

[63] Continuation of Ser. No. 546,924, Feb. 4, 1975, abandoned.

[51] Int. Cl.[2] ..... B65H 45/02

[52] U.S. Cl. ..... 270/82; 270/68 R; 270/85

[58] Field of Search ..... 270/80–82, 270/85, 67, 68 R; 271/189, 192, 218; 214/6 DK

[56] References Cited

U.S. PATENT DOCUMENTS

| | | | |
|---|---|---|---|
| 948,547 | 2/1910 | King | 270/80 |
| 2,355,105 | 8/1944 | Preston | 270/82 |
| 2,954,974 | 10/1960 | Kellett | 270/80 |
| 3,190,640 | 6/1965 | Sjostrom | 270/82 |
| 3,774,903 | 11/1973 | Sjoman | 270/80 |

*Primary Examiner*—E. H. Eickholt
*Assistant Examiner*—A. Heinz
*Attorney, Agent, or Firm*—Parmelee, Johnson & Bollinger

[57] ABSTRACT

A folder for laundered textile articles, particularly articles such as towels, pillowcases, etc., having an oscillatable folding blade which depends or pivots from a location above the folding rolls. The folder can feed the folded articles to a stacker which uses sloping pivoted plates instead of a conveyor, the plates being split crosswise of the travel of the folded articles thereover.

5 Claims, 13 Drawing Figures

LAUNDRY FOLDER AND STACKER

This application is a continuation of prior copending application Ser. No. 546,924, filed Feb. 4, 1975, and now abandoned.

This invention relates to textile article folding machines, especially for folding small articles, such as towels, pillowcases, diapers, gowns, and the like.

Prior laundry or textile article folding devices are known, such as shown in U.S. Pat. No. 3,752,470 wherein a folding blade is oscillatable about a pivot below the folding rolls. Laundry stackers also are known, such as seen in U.S. Pat. No. 3,477,708. It is desirable to have a relatively small and compact folder and stacker which can be used for small articles and for operations where space is limited.

One of the objects of the invention is to provide a compact textile article folding machine.

Another of the objects of the invention is to provide a compact textile folding machine and an improved stacker usable therewith.

In one aspect of the invention, articles to be folded are fed onto a conveyor which carries the articles toward the rear of the machine, the conveyor being supported on front (first roll) and rear (second roll) rolls. The rear roll (second roll) has a roll (third roll) located below the second roll which is juxtaposed relative to the rear roll and serves therewith as a pair of nip folding rolls. The folding blade is pivotally mounted with the pivot above said nip rolls so that it can swing as it is oscillated. An article holding abutment is located rearwardly of the blade so that the desired portion of the article can be held between the blade and abutment as the article continues to be fed to form loops therein. The folding blade also will hold a shorter article thereon without having to cooperate with the abutment. Upon timed actuation of the blade, the article is fed into the folding or nip rolls which then grip the same and fold the article as desired. The folded article is fed to a sloping surface which carries it to the forward part of the machine so that an operator can remove the same.

In another aspect, when a stacker is employed, the sloping surface can be a pair of pivoted plates which have abutting edges between the pivots which in effect forms a "trap door"-like configuration. A folded article slides down the plates until it reaches a stacker plate operating switch and an article stop or abutment which after a predetermined delay causes the plates to swing relative to each other so as to open and drop a folded article onto the receiving table or onto a previously delivered folded article thereon. The timing and operation of the plates should be such that the delay takes into account the bounce of the sliding article when it hits the article stop so that opening does not occur until the article has come to a substantially stopped position on the plates. The lower stacker plate stop or abutment must be away from the pivoted shaft for the plate. The rear stacker plate also must support an edge of the folded article prior to drop. The timing arrangement for the first measuring switch located before the rear roll can include a solid state timer with adjustments for the first fold and for the second and third folds of each of the selected lengths.

These and other objects, advantages and features of the invention will become apparent from the following description and drawings which are merely exemplary.

In the drawings.

Where appropriate, the same reference numerals will be used to designate similar parts in the various figures of the drawings.

Figure 1:
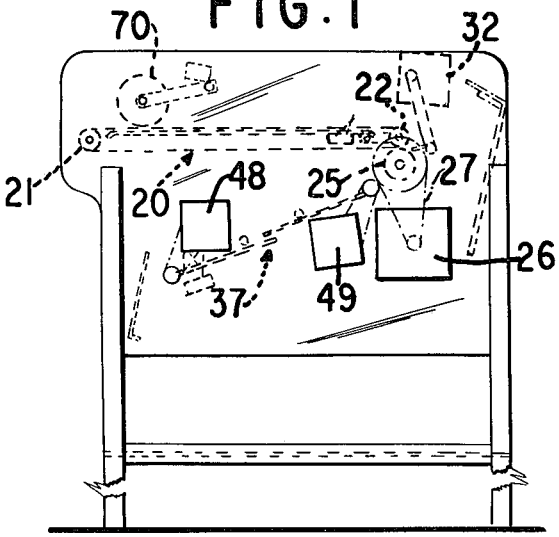
FIG. 1 is a partially schematic side view showing the invention in a combination folder and stacker.
Figure 2:
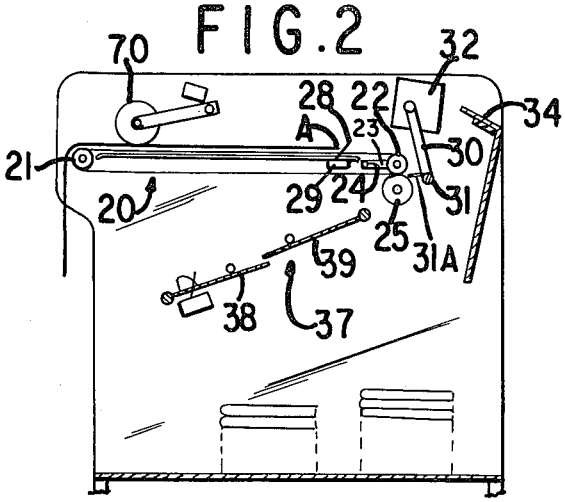
FIG. 2 is a diagrammatic sectional view similar to FIG. 1 showing an article, such as a towel, striking the first or fold measuring switch.

Referring first to FIGS. 1 and 2, conveyor means 20 can comprise endless belt arrangements operable over a first or front roll 21 and a second or rear roll 22. The second or rear roll can be mounted on arm means 23 on either side thereof which are pivoted at 24 on the machine, there being an arm means on each side of roll 22. A third or folding roll 25 is mounted in juxtaposed relation to the second roll 22 and below roll 22 so that roll 25 forms with roll 22 a folding station or forms a pair of nip rolls. The folding roll 25 is driven from motor 26 through suitable drive belt arrangements 27. The roll 22 is urged by gravity or in any suitable manner downwardly onto third roll 25. Thus, conveyor means 20 is driven by roll 25. Rolls 22 and 25 are separable so as to permit the articles to be folded to enter therebetween.

Figure 3:
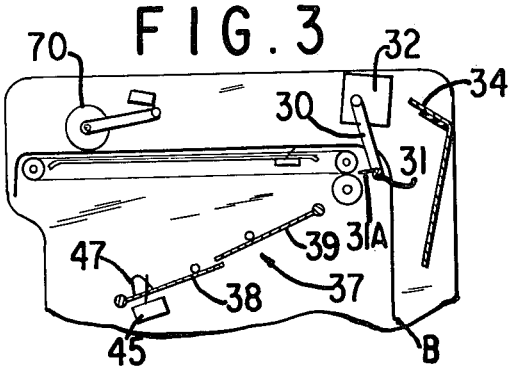
FIGS. 3, 4, 5 and 6 are fragmentary diagrammatic views similar to FIG. 2 showing successive folding operations of the machine.

When the leading edge A (FIG. 2) reaches measuring switch arm 28, a timer circuit will be started to permit the proper length of the towel or the article to be folded to pass over the folding blade means 30 as seen in FIG. 3. The folding blade means can comprise arms pivoted on each side of the machine, the arms being joined by a bar 31 having blade 31A thereon.

Figure 4:
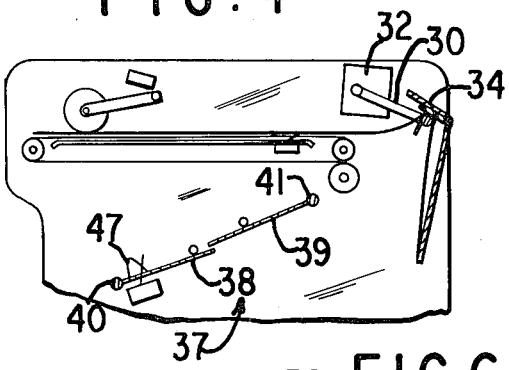
Figure 5:
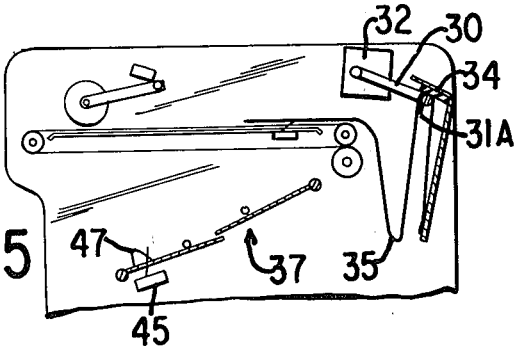
Figure 6:
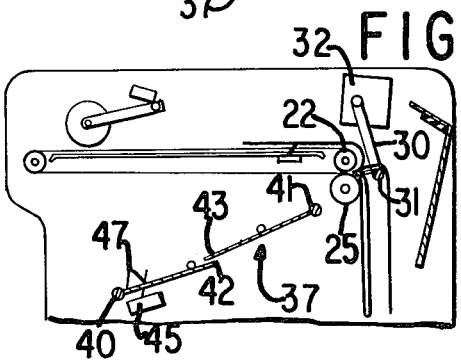

When the proper or predetermined length of the article has passed so that the leading edge reaches, for example, point B (FIG. 3), the timer and circuitry is arranged to cause blade operating motor 32 to rotate the folding blade means 30 counterclockwise to the position shown in FIG. 4 so as to bring the portion of the article resting on the blade bar 31 against the article holding abutment 34 as seen in FIG. 4. The speed of the rolls and drive is made such that a loop 35 will be formed as seen in FIG. 5. At the correct time, the timer arrangement will cause the circuit to function to reverse motor 32 and to move the folding blade means clockwise with the blade 31A causing the article to enter between nip or folding rolls 25 and 22 (FIG. 6). Such nip arrangement will cause the article to be drawn therebetween and folded so as to create the second and third folds as it passes through the folding rolls onto sloping plate means 37 (FIG. 7) of the stacker.

Figure 7:
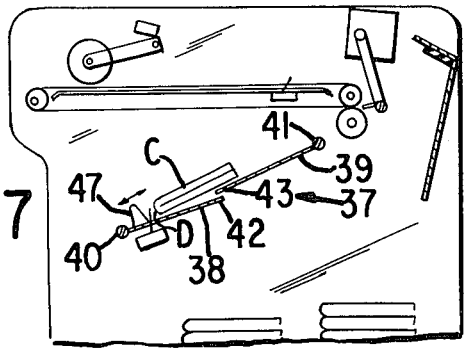
FIGS. 7, 8 and 9 are fragmentary diagrammatic sectional views similar to FIGS. 3 to 6 but after folding and showing the stacking functions of the apparatus.
Figure 8:
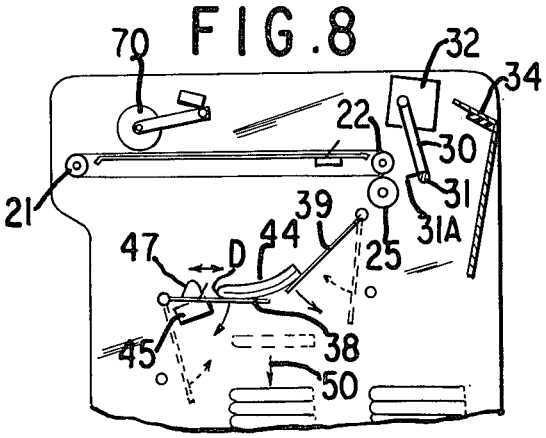
Figure 9:
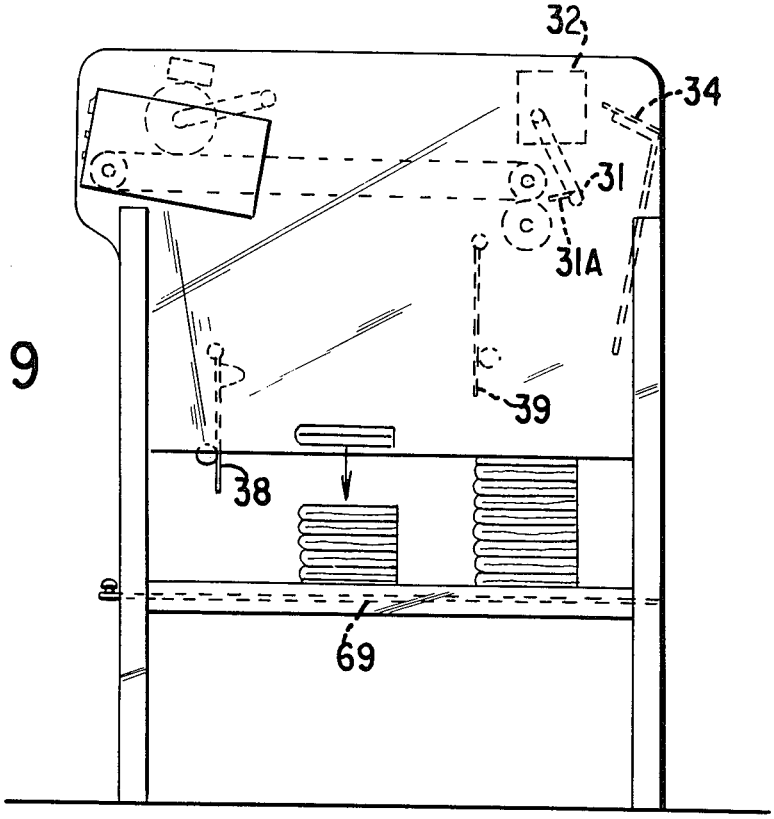

The stacker plates arrangement shown in FIG. 7 comprises plates 38, 39 which are pivoted at 40, 41 to the machine. The plate edges 42, 43 may overlap slightly so that the folded article C will slide thereover and downwardly until the leading edge D hits stacker switch 45. The stacker switch, as will be described hereafter, has a time delay arrangement which will compensate for the bounce which may occur when the leading edge D of the folded article C hits the stop 47. After the circuit actuated by switch 45 has had a sufficient delay, stacker motors 63, 64 (FIG. 13) will be actuated in a direction to cause stacker plates 38, 39 to open, similar to a trap door, as seen in FIG. 8. It has been found that it is desirable to make sure that the leading edge D of the folded article is carried onto stacker plate 38 until the plates are sufficiently opened to permit the folded article to drop downwardly as shown in the direction of arrow 50 (FIG. 8). Following this operation, the timer and circuit arrangement will cause reversal of the stacker plates so as to return them to the initial position as shown in FIG. 3.

The stop 47 needs to be spaced from shaft 40 so that the article will not rest against the shaft 40 as the plate 38 is opened.

Figure 10:
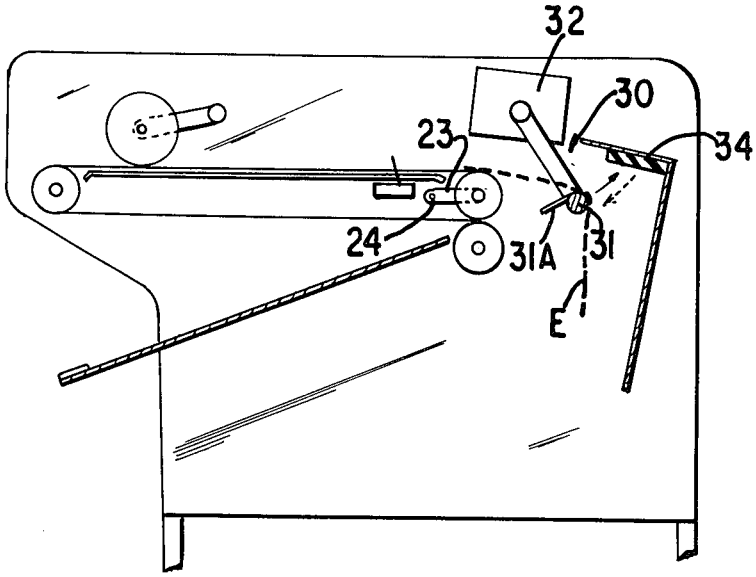
FIG. 10 is similar to FIG. 4 except it shows a machine without the stacker and folding a short article that is not held against the rear holding abutment.

FIG. 10 illustrates a folder without a stacker. Also, there is depicted therein the manner in which the folder can operate with very short articles which is made possible by the folding blade being pivotally supported above the folding rolls. The folding blade arm means 30, because of the length of the article being folded, has only moved part way towards abutment 34 instead of all the way as in FIG. 4. The friction of the article on bar 31 and blade 31A will stop the article thereon as the feed mechanism continues forming a loop, as in FIG. 5. The folding blade means 30 is then reversed (clockwise) to bring the article into the nip rolls as in FIG. 6.

The nip rolls will impart or regulate movement of the article as it is deposited upon the stacker plates or the inclined plate. The rolls will either accelerate or hold back the article.

Figure 11:
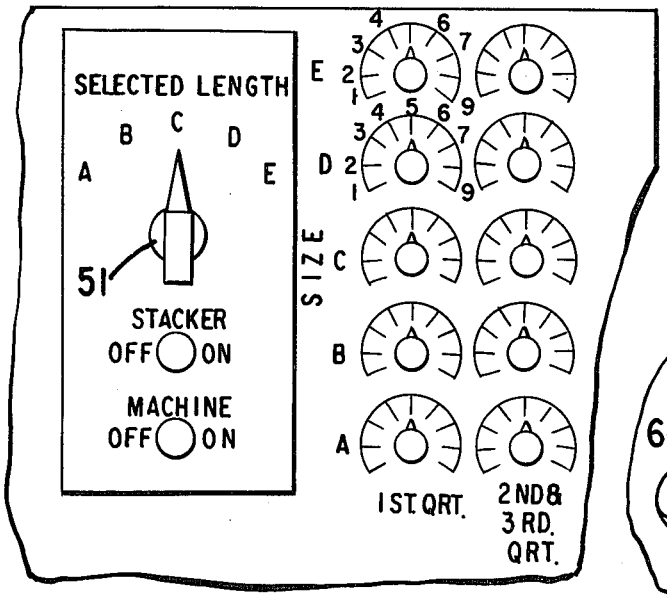
FIG. 11 is a fragmentary enlarged view of a control.

The control circuit for the timer can be arranged so as to be adjustable easily to provide the type of fold desired. As will be explained in conjunction with the circuit of FIG. 13, a selector switch 51 (FIG. 11) can be turned to the selected length of the article position, A, B, C, D, E, each involving a timing circuit in the timer involved. Then the corresponding potentiometer or other control means for the selected length can be adjusted to control movement of the folding blade motor 32 to obtain the correct or desired fold. Thus, there are only two controls to adjust for each of the selected lengths.

Summarizing operation of the fold timing arrangement, the narrow edge of the piece A is fed into the machine. The leading edge thereof actuates the measuring switch 29 at the rear end of conveyor 20. Striking switch 29 starts the timing cycle. After the piece has passed about one-fourth its length past this point (FIG. 3), the folding blade 30 moves back and grips the article against abutment 34 (FIG. 4) at that point to form the first quarter. The length of the first quarter can be altered by the potentiometer or control means on the control marked "1st QTR" corresponding to the selected length to make it an exact one-fourth of the article. The folding blade will remain in the position of FIG. 4 and hold the first quarter while the conveyor 20 continues to move the remainder of the piece forward to form a loop 35 as seen in FIG. 5. The loop 35 will become the second and third quarters, the length thereof being controlled by the corresponding potentiometer marked "2nd and 3rd quarter." When the depth of the loop 35 is equal to the length of the first quarter, the folding blade means 30 moves forward and pinches the article at that point between the nip rolls. If the dial or control settings are correct, the trailing length will be equal to the first three quarters. The same holds true for the small article described in conjunction with FIG. 10 except that the blade means does not move as far.

Figure 13:
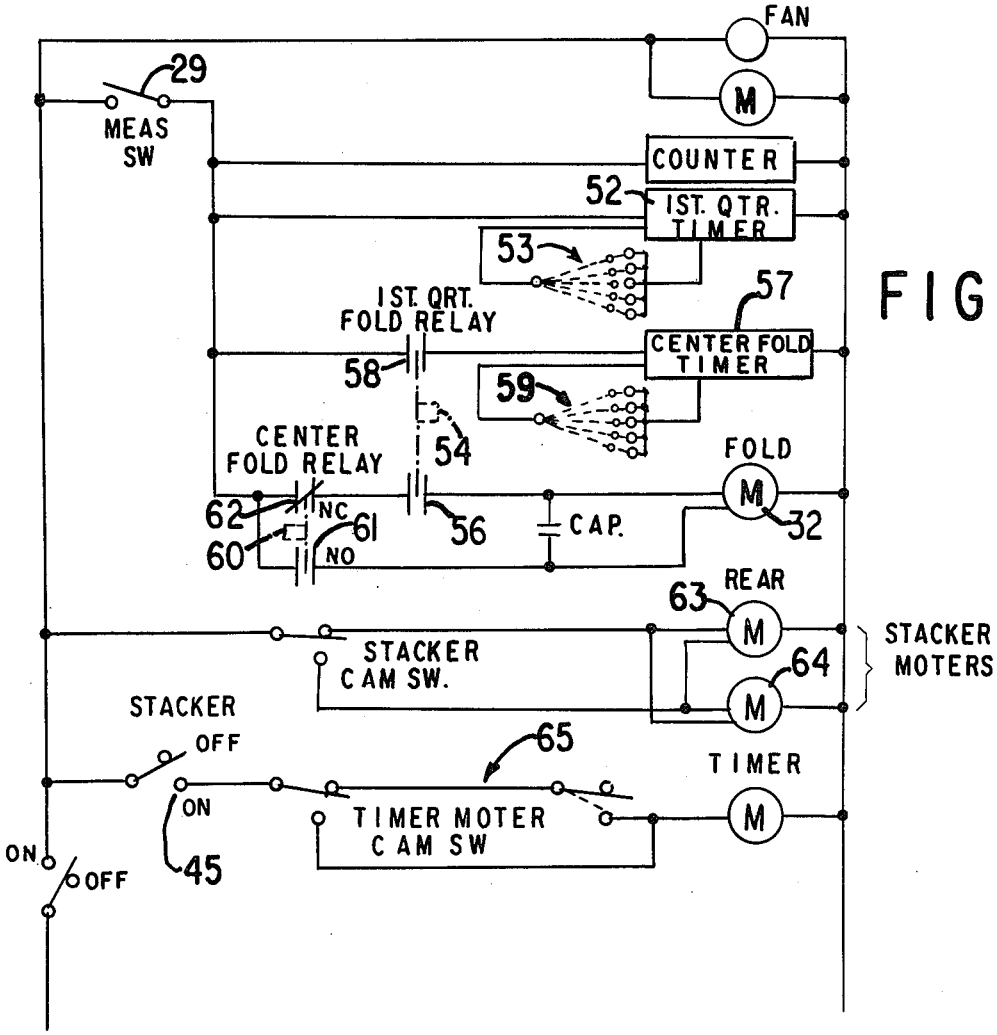
FIG. 13 is a schematic wiring diagram.

Referring to FIG. 13, when measuring switch 29 is closed by an article, the 1st quarter timer 52 is energized. Timer 52 governs the time when the folding arm moves back to the position of FIG. 4. The selected length switch potentiometer or control means are schematically shown at 53. When it reaches the set time, the 1st quarter folder relay 54 will be energized to close switch 56 energizing fold motor 32 to move the folding blade means 30 rearwardly (FIG. 4), switch contacts 56 having been closed by the 1st quarter fold relay. At the same time, center fold timer 57 has been energized through switch contact 58. The centerfold timer has controls 59 similar to timer 52. When the centerfold timer times out or reaches the selected time, the centerfold relay 60 will be energized to close normally open switch contacts 61 so as to operate fold motor 32 in the opposite direction or to the position of FIG. 6. The normally closed switch contacts 62 also are opened to permit the reverse actuation. Suitable limit switches (not shown) can be employed when needed.

Figure 12:
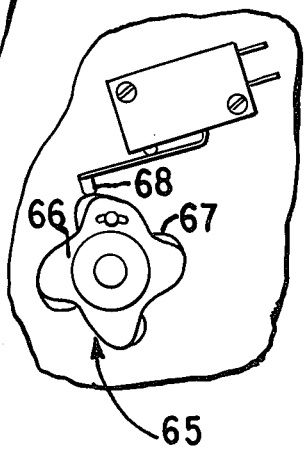
FIG. 12 is a fragmentary enlarged view of a timer apparatus cam for the stacker.

After the folded article has been deposited on the stacker plates, it will slide down and hit stacker or drop switch 45 to energize the stacker motors 63, 64 which turn shafts 40, 41, respectively. The stacker motors are operated by the timer motor cam switch 65 which can be similar to that illustrated in FIG. 12 having two cams 66, 67 which are adjustable relative to each other. The cams provide a delay until the cam follower 68 is raised out of the depression. The motors will be operated and then reversed so as to close the plates in readiness for the next article.

A slidable table 69 can be arranged to receive the articles and then moved to receive a second pile while the first pile is being removed.

If desired, rolls 70 may be provided at the front of the machine to temporarily hold an article as it is fed thereto by the operator.

It should be apparent that details of construction can be varied without departing from the spirit of the invention except as defined in the appended claims.

What is claimed is:

1. In a laundry textile article folding and stacking machine, apparatus including endless belt conveyor means extending horizontally from front to rear of the machine for freely receiving an article to be folded placed on top thereof near the front of the machine and carrying the article to the rear thereof, the article having a leading edge in the direction of travel which is moved toward the rear of the machine by said conveyor means, said conveyor means including belt means supported by first and second roll means, said first roll means being toward the front of the machine and said second roll means being toward the rear thereof and over which said leading edge freely passes, third roll means juxtaposed relative to and below said second roll means in nip relationship with said second roll means for forming a folding station therewith, downwardly depending oscillatable arm means pivotally mounted on pivot means located generally above said second and third rolls means, said arm means having a lower end with folding blade means mounted on said lower end, said folding blade means being positioned opposite said folding station, an abutment surface located to the rear of said second and third roll means, motor and timing means connected to said oscillatable arm means for swingably oscillating said folding blade means relative to said second and third roll means and relative to said abutment surface, the leading edge of said article passing over said second roll means and over said blade means and depending downwardly to the rear of said blade means when said blade means is initially positioned near said second and third roll means, said blade means being swung away from said second and third roll means and toward said abutment surface after a predetermined length of said article from its leading edge has passed over said second roll means and over said blade means for holding said predetermined length of the article against said abutment surface for forming a loop in said article between said blade means and said second and third roll means, and the looped article then being moved toward and being inserted into the folding station between said second and third roll means by said blade means being swung toward said second and third roll means to fold said article, and a substantially planar stacking surface located below and adjacent the side of said second and third roll means toward the front of the machine, said stacking surface sloping downwardly and forwardly from said second and third roll means to receive folded articles from said folding station which freely slide onto said sloping surface and therealong, said stacking surface comprising a pair of swingable stacker plates each pivoted at an outside edge and having free edges therebetween which extend crosswise of the movement of an article down said plates, and the free edges of said plates overlapping each other, with the free edge of the plate nearest to the folding station being on top of the free edge the other plate so that a folded article will slide thereover.

2. In a laundry textile article folding and stacking machine, apparatus as claimed in claim 1, and including motor means connected to said stacker plates to swing their free edges downwardly, and switch means connected to said motor means for operating said stacker plates when an article straddles the overlapping free edges of said stacker plates.

3. In a laundry textile article folding and stacking machine, apparatus as claimed in claim 2, wherein there is a stop means near the pivoted edge of said other stacker plate for stopping a foldable article when it straddles the overlapping free edges of said stacker plates, and wherein said switch means includes a delay switch which delays operation of said stacker plates after operation of the switch by an article so as to compensate for bounce of a folded article against said stop means.

4. In a laundry textile article folding and stacking machine, apparatus as claimed in claim 1, wherein said downwardly depending oscillatable arm means comprise a pair of arms respectively pivotally mounted by pivot means one each side of the machine, a horizontal bar joining said lower end of said arms, said folding blade means being mounted on said bar, and said arms being spaced apart for allowing the leading edge portion of a laundered textile article to pass between said arms thereby to hang downwardly by gravity to the rear of said folding blade.

5. In a laundry textile article folding and stacking machine, apparatus as claimed in claim 4, wherein said horizontal bar which joins said arms is positioned for holding said predetermined length of the article against said abutment surface when said blade means is swung away from said second and third roll means.

* * * * *